United States Patent [19]

Hickling

[11] 4,257,379

[45] Mar. 24, 1981

[54] CARBURETOR

[75] Inventor: Nelson F. Hickling, Toledo, Ohio

[73] Assignee: John-Nelson Corporation, Toledo, Ohio

[21] Appl. No.: 52,938

[22] Filed: Jun. 28, 1979

Related U.S. Application Data

[63] Continuation-in-part of Ser. No. 908,973, May 24, 1978.

[51] Int. Cl.[3] ..... F02M 25/08; F02M 37/20

[52] U.S. Cl. ..... 123/518; 261/41 B; 261/44 B; 261/50 A

[58] Field of Search ..... 261/44 D, 41 B, 44 A, 261/44 B, 44 C, 50 A, DIG. 39, DIG. 74, 36 A, 34 A; 123/136, 139 AW

[56] References Cited

U.S. PATENT DOCUMENTS

| | | | |
|---|---|---|---|
| 1,688,285 | 10/1928 | Purvis | 261/41 B |
| 1,692,299 | 11/1928 | Harding | 261/44 B |
| 1,971,494 | 8/1934 | Lesage | 261/44 B |
| 2,047,661 | 7/1936 | Arff | 261/44 B |
| 2,967,049 | 1/1961 | Stearns | 261/DIG. 74 |
| 3,039,485 | 6/1962 | Brohl | 261/36 A |
| 3,086,758 | 4/1963 | Greene | 261/41 B |
| 3,350,073 | 10/1967 | Hill | 261/50 A |
| 3,362,694 | 1/1968 | Gould | 261/34 A |
| 3,432,152 | 3/1969 | Sweeney | 261/50 A |
| 3,752,454 | 8/1973 | Korponay | 261/41 B |
| 3,822,058 | 7/1974 | Carter | 261/44 B |
| 4,013,741 | 3/1977 | Edmonston | 261/44 R |
| 4,083,344 | 4/1978 | Sakurai | 123/136 |
| 4,097,562 | 6/1978 | Blakeway | 261/44 B |
| 4,133,848 | 1/1979 | Black | 261/41 B |

*Primary Examiner*—Ronald H. Lazarus
*Assistant Examiner*—Carl Stuart Miller
*Attorney, Agent, or Firm*—Allen D. Gutchess, Jr.

[57] ABSTRACT

A carburetor with a pressurized fuel source is provided. The carburetor has an upright passage extending therethrough with an intermediate fuel-supply portion in which is located a fuel injection tube having a plurality of orifices extending therealong through which fuel is directed under pressure into the passage. An air-control slide valve is mounted for movement across the passage between an open and a closed position and has a closure member or plug which regulates the number of orifices of the injection tube through which the fuel is supplied. The closure member is connected to the accelerator pedal in a manner such that the member opens at least one additional orifice during acceleration before the air-control slide valve opens more, to provide additional fuel during acceleration. Also, during deceleration, the closure member closes at least one additional orifice before the slide valve moves toward the closed position. The carburetor also has a vapor receptacle through which fuel is supplied before being supplied to the injection tube. The receptacle has a return line connected to the fuel tank so that if fuel tends to vaporize in the receptacle, the vapors are fed back to the tank to prevent vapor lock.

14 Claims, 7 Drawing Figures

CARBURETOR

This application is a continuation-in-part of my copending application, Ser. No. 908,973, filed on May 24, 1978.

This invention relates to a carburetor for an internal combustion engine.

A carburetor in accordance with the invention includes a body forming a generally upright passage through which air and fuel are supplied to an engine manifold located therebelow. This passage includes an upper air-intake portion above which can be an air filter, an intermediate fuel-supply portion, and a lower fuel-air mixing portion communicating with the intake manifold. The body carries a fuel injection tube extending across the intermediate portion of the upright passage and having two rows of orifices extending therealong. The orifices are preferably located in the sides of the tube generally perpendicular to the flow of air through the upright passage and are staggered in the two rows so that only one orifice is opened or closed at a time. An air-control slide valve is movably carried by the carburetor body for movement across the intermediate portion of the upright passage between a closed position substantially closing the passage and an open position substantially opening the passage. The slide valve has a bore in which a control member or plug is carried, with the bore and the plug being in alignment with the injection tube. The tube diameter and the bore and plug diameters are sufficiently close that the slide valve and plug effectively open and close off the orifices when moved.

The control plug is connected through the slide valve to the accelerator pedal with lost-motion provisions such that during acceleration, the control plug uncovers an additional orifice before the slide valve moves toward the open position. Similarly, during deceleration, the control plug closes off an additional orifice before the slide valve moves toward the closed position. This provides additional power during acceleration and increased fuel economy during deceleration.

Fuel from a fuel pump and a pressure regulator are supplied under pressure to the injection tube and the orifices and the fuel is fully vaporized as it is injected into the upright passage through the orifices. Before being supplied to the injection tube, the fuel is supplied to a vapor receptacle built into the carburetor. The vapor receptacle is connected by a vent line to the fuel tank and any fuel which is vaporized in the receptacle is returned through the vent line to the tank. This prevents the possibility of vapor lock which otherwise has a tendency to occur, particularly in hot weather.

An idle supply passage communicates with the fuel-air mixing passage below the slide valve and has an adjustable needle valve to control fuel therethrough. This passage provides fuel for idling when the orifices in the injection tube are closed. In addition, an adjustable stop member is carried by the carburetor body and projects into an intermediate portion of the passage, into the path of the slide valve, to control the closed position thereof. This closed position enables a controlled amount of air to pass by the slide valve during idling to provide a proper idle mixture.

The high degree of vaporization of the fuel directed under pressure through the injection tube into the upright passage is believed to contribute to the improved performance of the new carburetor along with the lost-motion action of the control plug. When substituted for commercially-available carburetors of automobile engines, the new carburetors brought about improved fuel economy and also tended to reduce pollution emissions.

It is, therefore, a principal object of the invention to provide an improved carburetor for internal combustion engines having the features and advantages discussed above.

Many other objects and advantages of the invention will be apparent from the following detailed description of a preferred embodiment thereof, reference being made to the accompanying drawings, in which.

Figure 1:
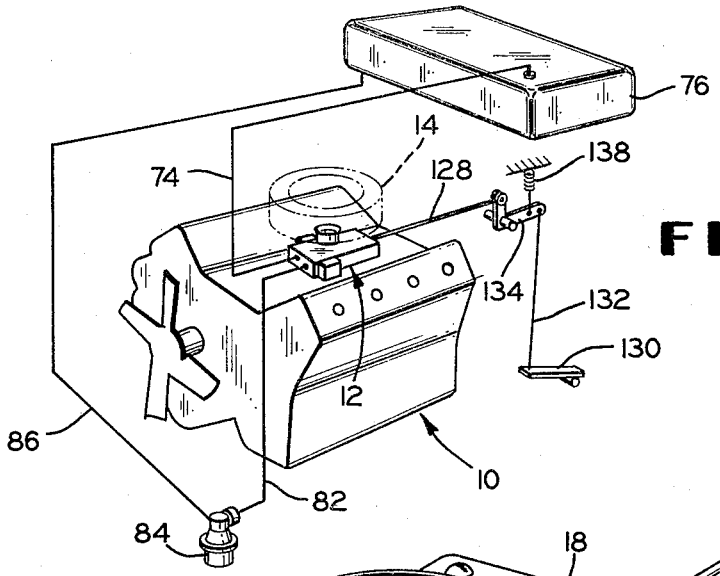
FIG. 1 is a schematic view in perspective of an internal combustion engine utilizing a carburetor in accordance with the invention.
Figure 2:
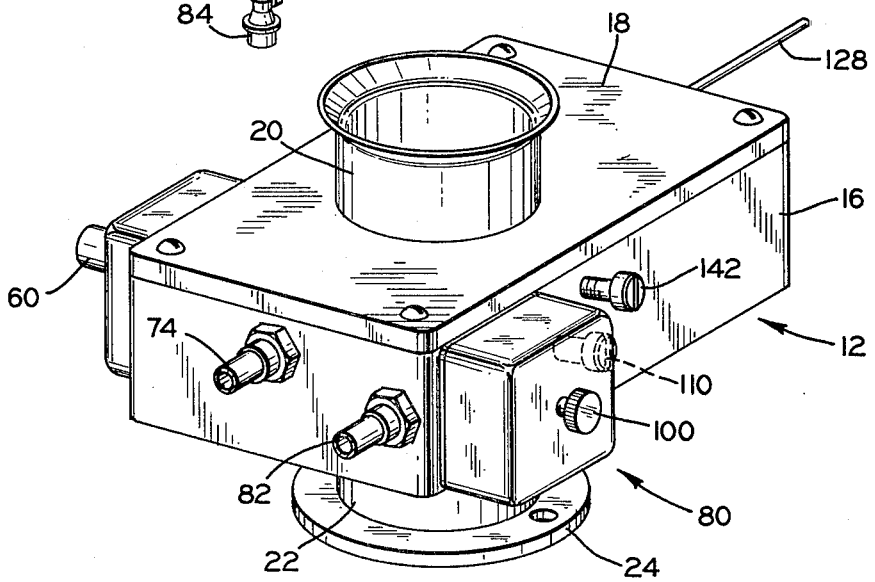
FIG. 2 is a somewhat schematic, enlarged view in perspective of the carburetor of FIG. 1.

Referring particularly to FIG. 1, an internal combustion engine 10 is shown schematically as a V-8 and utilizes a carburetor 12 in accordance with the invention, an air cleaner 14 being shown in dotted lines thereabove. As shown in FIG. 2, the carburetor 12 includes a main body 16 and a cover 18, with an upper tube 20 communicating with the air cleaner and with a lower tube 22 communicating with the intake manifold of the engine, being mounted thereon by a mounting flange 24. However, in some instances, the carburetor can be mounted directly on the manifold with the lower tube 22 being omitted.

A main upright passage 26 (FIG. 3) is formed through the carburetor body and cover with the main passage including an upper, air intake portion 28, an intermediate, fuel supply portion 30, and a lower air-fuel mixing portion 32.

Figure 6:
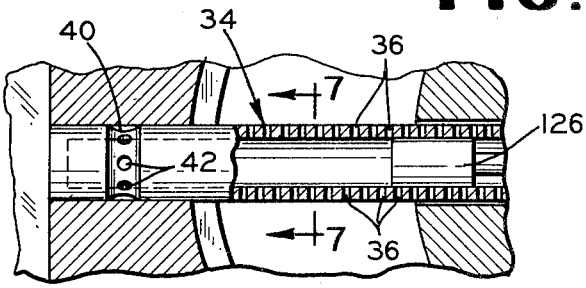
FIG. 6 is an enlarged, fragmentary view in horizontal cross section of a portion of the carburetor.
Figure 7:
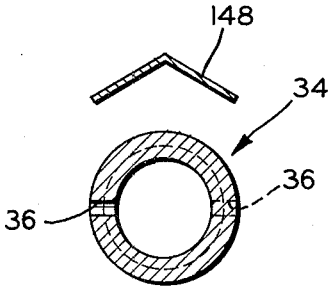
FIG. 7 is a view in transverse cross section section taken along the line 7—7 of FIG. 6.

A fuel injection tube 34 (also see FIGS. 6 and 7) is generally horizontally disposed across the intermediate portion 30 of the main passage 26. The tube 34 has fuel-supply orifices 36 located in two rows, with the orifices preferably being staggered. The orifices are preferably located on the sides of the injection tube 34 perpendicular to the air flow through the passage 26. By way of a specific example, there can be forty of the orifices 36 located in two rows, with the orifices having diameters of 0.005 to 0.010 inch, and preferably about 0.008 inch. The orifices in each row are spaced apart about 0.30 to 0.60 inch, and preferably about 0.050 inch. With the staggered arrangement, the orifices are then spaced apart about 0.025 inch longitudinally of the injection tube 34.

The tube 34 is suitably affixed in the bore 38 in the carburetor body 16. The tube has a closed end with an annular groove 40 spaced therefrom having radial holes 42 communicating with the interior of the tube.

Figure 4:
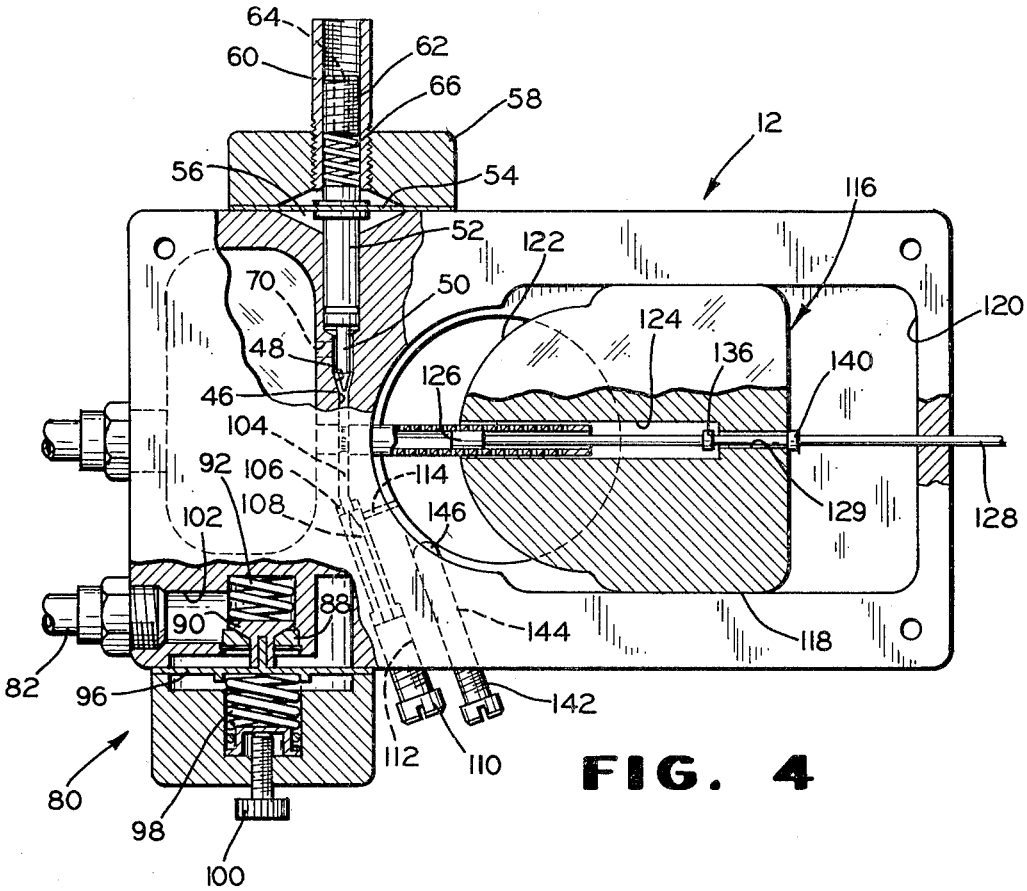
FIG. 4 is a plan view of the carburetor with the cover removed, and with parts broken away and with parts in cross section.
Figure 5:
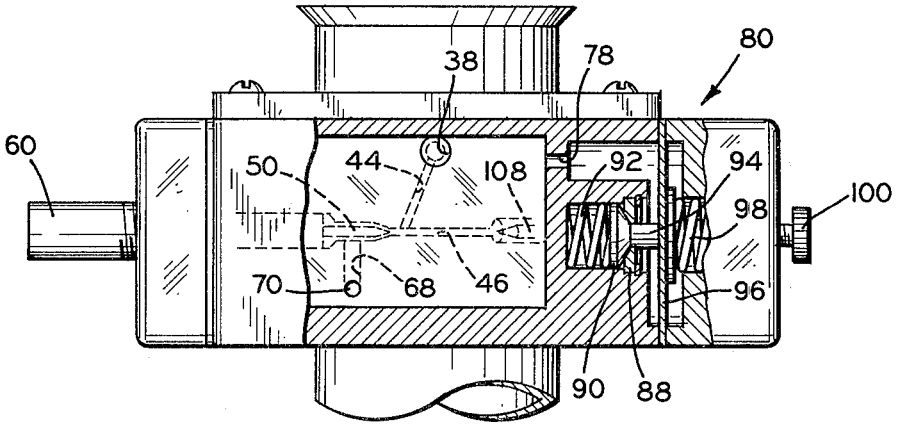
FIG. 5 is a front view in elevation of the carburetor, with parts broken away and with parts in cross section.

A fuel supply passage 44 communicates with the bore 38 at the annular groove 40 and extends to a valve passage 46 (see FIGS. 4 and 5) forming a valve seat 48. A vacuum shutoff valve 50 opens and closes the passage 46 to control the supply of fuel therethrough. The valve 50 is connected to a shank 52 which extends to a diaphragm 54 located in a chamber 56 formed by a recess in the carburetor body 16 and a recess in a cylindrical member 58. A sleeve 60 is threadedly engaged in the cylinderical member 58 and has an adjusting nut 62 threadedly received therein with a bore 64 extending through the nut. The adjusting nut 62 changes the degree of compression on a coil spring 66 which changes the force on the valve 50 and the degree it is opened when vacuum is applied to the end of the sleeve 60, with the vacuum communicating with the diaphragm 54 through the bore 64.

Figure 3:
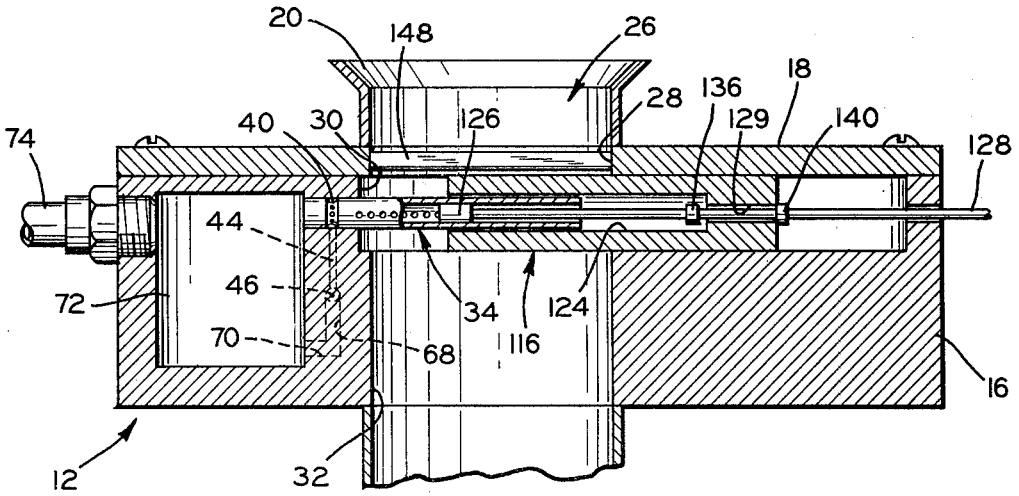
FIG. 3 is a view in longitudinal, vertical cross section of the carburetor.

When the valve 50 is opened, away from the valve seat 48, the fuel is supplied to the passage 46 from an upright passage 68 behind the valve seat which, in turn, communicates with a supply port 70 (FIG. 3). Fuel is supplied to the port 70 from a vapor receptacle or container 72 which is built into the carburetor body 16. The receptacle 72 is important in preventing vapor lock or at least not allowing vaporized fuel to stop operation of the carburetor. With the receptacle 72, if the fuel should vaporize during hotter weather, the vapor collects at the top of the receptacle and is returned through a vapor line 74 to the top of a fuel tank 76 (FIG. 1) of the vehicle in which the engine and carburetor are mounted. The liquid fuel in the receptacle 72 is supplied through the lower port 70 to the injection tube 34.

The fuel is supplied to the upper portion of the receptacle 72 through a supply port 78 (FIG. 5) from a built-in pressure regulator 80. Fuel to the pressure regulator is supplied by a line 82 from a fuel pump 84 receiving fuel from the tank 76 through a line 86.

The pressure regulator 80 supplies fuel to the carburetor at a pressure from about four to about seven psi. The regulator includes a valve seat 88 with a valve 90 urged thereagainst by a spring 92 with the valve 90 having a stem 94 engaging a diaphragm 96. The stem 94 and the valve 90 tend to be urged away from the valve seat 88 by an adjustable spring 98 on the opposite side of the diaphragm 96, the compression of which can be controlled by an adjusting screw 100. Fuel enters the pressure regulator 80 through a passage 102 with the pressure tending to close the valve 90 as the pressure increases, thereby reducing the amount and pressure of the fuel entering the vapor receptacle 72.

To supply a controlled amount of fuel to the engine when idling, an additional fuel passage 104 extends from the passage 46 to a valve seat 106. A valve rod 108 seats against the seat or is spaced a controlled distance therefrom by means of an adjustable screw 110 affixed to the valve rod and located in a threaded recess 112 in the carburetor body 16. Thus, a controlled amount of fuel is supplied through an idling bore 114 which communicates with the lower portion 32 of the passage 26.

A slide valve 116 controls the flow of air downwardly through the main passage 26 and also controls the flow of fuel through the injection tube 34. The slide valve 116 has a body portion 118 suitably located in an elongate, shallow recess 120 formed by the carburetor body 16 and the cover 18. The slide valve 116 also has a forwardly extending, semi-circular end 120 which fits closely with one-half of the intermediate portion 30 of the passage 26, when closed. The semi-circular contour of the passage portion 30 and the slide valve 20 causes the air-fuel ratio to stay substantially the same as the slide valve 116 opens, until it is approximately one-half opened. At this time, the air-fuel ratio begins to decrease and the mixture becomes increasingly richer as the slide valve approaches the fully opened position. This provides additional fuel during higher speed acceleration, exactly when it is needed.

The slide valve 116 has a central bore 124 which is aligned with the injection tube 34 and parallel to the direction of movement of the valve, the bore closely fitting with the outer diameter of the tube 34. A closure member or plug 126 is concentrically located within the bore 124 and has a diameter closely fitting with the inner diameter of the tube. The slide valve 116 thereby is effective to close and open the fuel orifices in the tube 34 as the slide valve moves between the open and closed positions. Since they orifices 36 are staggered, only one is opened or closed at a time, thereby providing close control over the fuel supply.

In accordance with the invention, the closure member 126 is connected to an elongate control rod or member 128 which extends through a passage 129 in the carburetor body 16 and is suitably connected to an accelerator pedal 130 (FIG. 1). As shown, the accelerator pedal 130 is connected by a cable 132 to one end of an L-shaped lever 134, the other end which is pivotally connected to the control rod 128. The control rod 128 has an enlargement or shoulder 136 in the bore 124 and which abuts the end of the bore 124 as the control rod moves out of the carburetor body. Until the enlargement 136 abuts the end of the bore of the slide valve 116, the slide valve remains stationary due to friction and the force of air passing through the main passage 26. However, as the control rod 128 moves outwardly, the closure member 126 uncovers an additional one of the orifices 36 to supply additional fuel to the carburetor as the accelerator foot pedal is depressed. This provides a temporary richer air-fuel mixture during acceleration, when it is needed.

When the accelerator pedal is let up during acceleration, a spring 138 pushes the control rod 128 into the carburetor. Function and airflow keep the slide valve 116 in position until a second enlargement 140 on the control rod abuts the end of the slide valve. During this movement, the closure member 126 closes off another one of the orifices 36, thereby providing a leaner air-fuel mixture during deceleration, which promotes fuel economy. When the enlargement 140 abuts the end of the slide valve, it then moves the slide valve toward the closed position.

An idle air control screw 142 has a threaded shank 144 at the same level as the slide valve 116 with a blunt end 146 abutting the forward end 122 of the slide valve when projecting into the passage 26. In this adjustable position, the closed position of the slide valve can be controlled to enable some air to pass therearound and thereby provide air for idling along with the idle fuel supplied through the port 114.

The enlargements 136 and 140 on the control rod 128 preferably are spaced apart a distance about equal to the distance between the staggered orifices 36 along the tube 34 plus the length of the passage 129 between the enlargements. This enables one orifice to be opened and one to be closed during each period of acceleration and deceleration.

An air deflector 148 (FIGS. 3 and 7) can be built into the cover 18 to deflect the air around the tube 34, which promotes air-fuel mixing.

Various modifications of the above-described embodiment of the invention will be apparent to those skilled in the art, and it is to be understood that such modifications can be made without departing from the scope of the invention, if they are within the spirit and tenor of the accompanying claims.

I claim:

1. Fuel control means for supplying an air-fuel mixture to an internal combustion engine, said control means comprising a body, said body forming an upright main passage extending therethrough and having an upper air intake portion, a lower air-fuel mixing portion, and an intermediate fuel-supply portion, a slide valve mounted for movement across said intermediate portion of said passage and movable between a position substantially closing said intermediate portion and a position substantially fully opening said intermediate portion, said slide valve having a bore centrally located therein parallel to the direction of movement of said slide valve, an injection tube carried by said body and extending across said intermediate portion of said passage in axial alignment with said slide valve bore, said injection tube having orifices extending along a substantial portion of the length thereof and transversely to the longitudinal extent of said passage, a vapor receptacle formed in said carburetor body, fuel supply means connecting a lower portion of said vapor receptacle with the interior of said injection tube, means for supplying fuel under pressure to said vapor receptacle, a vapor return line for connecting an upper portion of said receptacle to a fuel supply tank, a closure member carried by said slide valve in said bore, said injection tube having an inner diameter fitting closely with outer diameter of said closure member, said closure member being effective to close said orifices as said valve moves toward the closed position and being effective to open said orifices as said valve moves toward the open position, means for connecting said closure member to an accelerator pedal for causing movement of said closure member, and lost-motion means connecting said connecting means to said slide valve, whereby said closure member can move toward the open position before said slide valve moves toward the open position and said closure member can move toward the closed position before said slide valve moves toward the closed position.

2. Fuel control means according to claim 1 characterized by said fuel supply means comprising a fuel pressure regulator carried by said carburetor body, said regulator communicating with a lower portion of said vapor receptacle.

3. Fuel control means according to claim 1 wherein said lost-motion means causes said closure member to open and close one orifice before said slide valve moves toward the open and closed positions.

4. Fuel control means according to claim 1 characterized by said connecting means extending through a passage in said slide valve and said lost-motion means comprising two enlargements on said connecting means to contact said slide valve, said enlargements being spaced apart a distance exceeding the length of said slide valve passage.

5. Fuel control means according to claim 4 characterized by the spacing of said enlargements exceeding the length of said slide valve passage by a distance that is at least equal to the spacing of said orifices along said injection tube.

6. Fuel control means according to claim 1 characterized by said orifices being positioned in two rows along side injection tube and staggered with respect to one another, said lost-motion means enabling said closure member to move a distance at least one-half the space between the orifices in each row prior to said slide valve moving.

7. Fuel control means for supplying an air-fuel mixture to an internal combustion engine, said control means comprising a body, said body forming an upright main passage extending therethrough and having an upper air intake portion, a lower air-fuel mixing portion, and an intermediate fuel-supply portion, a slide valve mounted in said body for movement across said intermediate portion of said passage and movable between a position substantially closing said intermediate portion and a position substantially fully opening said intermediate portion, said slide valve having a bore centrally located therein parallel to the direction of movement of said slide valve, a closure member carried by said slide valve in said bore, an injection tube carried by said body and extending across said intermediate portion of said passage in axial alignment with said slide valve bore and having an inner diameter fitting closely with the outer diameter of said closure member, said tube having orifices extending along a substantial portion of the length thereof and transversely to the longitudinal extent of said passage, said closure member being effective to close said orifices as said valve moves toward the closed position and being effective to open said orifices as said valve moves toward the open position, means for connecting said closure member to an accelerator pedal for causing movement of said closure member, and lost-motion means connecting said connecting means to said slide valve, whereby said closure member can move toward the open position before said slide valve moves toward the open position and said closure member can move toward the closed position before said slide valve moves toward the closed position, and means for supplying fuel under pressure to said injection tube.

8. Fuel control means according to claim 7 characterized by said last-named means including first fuel supply passage means in said body, a pressure regulator carried by said body and communicating with said fuel supply passage means, a vapor receptacle located in said body, second fuel supply passage means connecting said pressure regulator with said vapor receptacle, and additional passage means connecting said vapor receptacle with said injection tube.

9. Fuel control means according to claim 8 characterized by said second fuel supply passage means communicating with an upper portion of said vapor receptacle, said additional passage means communicating with a lower portion of said vapor receptacle, and a vapor return line for connecting an upper portion of said vapor receptacle with a fuel supply tank.

10. Fuel control means according to claim 8 characterized by second additional fuel supply passage means communicating with said additional fuel supply passage means and with said air-fuel mixing portion of said passage below said slide valve, and an adjustable valve communicating with said second additional supply passage means for adjustably controlling the flow of fuel therethrough to said air-fuel mixing portion of said passage.

11. Fuel control means according to claim 7 wherein said lost-motion means causes said closure member to open and close one orifice before said slide valve moves toward the open and closed positions.

12. Fuel control means according to claim 7 characterized by said connecting means extending through a passage in said slide valve and said lost-motion means comprising two enlargements on said connecting means to contact said slide valve, said enlargements being spaced apart a distance exceeding the length of said slide valve passage.

13. Fuel control means according to claim 12 characterized by the spacing of said enlargements exceeding the length of said slide valve passage by a distance that is at least equal to the spacing of said orifices along said injection tube.

14. Fuel control means according to claim 7 characterized by said orifices being positioned in two rows along said injection tube and staggered with respect to one another, said lost-motion means enabling said closure member to move a distance at least one-half the space between the orifices in each row prior to said slide valve moving.

* * * * *